US007954465B2

(12) United States Patent
Huang

(10) Patent No.: US 7,954,465 B2
(45) Date of Patent: Jun. 7, 2011

(54) COMBINED EXHAUST RESTRICTION AND VARIABLE VALVE ACTUATION

(75) Inventor: Shenquiang Huang, West Simsbury, CT (US)

(73) Assignee: Jacobs Vehicle Systems, Inc., Bloomfield, CT (US)

( * ) Notice: Subject to any disclaimer, the term of this patent is extended or adjusted under 35 U.S.C. 154(b) by 949 days.

(21) Appl. No.: 11/202,201

(22) Filed: Aug. 12, 2005

(65) Prior Publication Data

US 2006/0060166 A1 Mar. 23, 2006

Related U.S. Application Data

(60) Provisional application No. 60/601,984, filed on Aug. 17, 2004.

(51) Int. Cl.
*F01L 1/34* (2006.01)

(52) U.S. Cl. ..... 123/90.15; 123/90.16; 123/90.17

(58) Field of Classification Search ..... 123/90.15, 123/90.11, 90.16, 90.17
See application file for complete search history.

(56) References Cited

U.S. PATENT DOCUMENTS

| | | | | |
|---|---|---|---|---|
| 3,220,392 | A | 11/1965 | Cummins | |
| 4,848,289 | A | 7/1989 | Meneely | |
| 5,146,890 | A | 9/1992 | Gobert | |
| 5,813,231 | A | 9/1998 | Faletti et al. | |
| 6,109,027 | A | 8/2000 | Schaefer | |
| 6,170,474 | B1 | 1/2001 | Israel | |
| 6,179,096 | B1 | 1/2001 | Kinerson | |
| 6,269,642 | B1 | 8/2001 | Arnold et al. | |
| 6,510,824 | B2 | 1/2003 | Vorih et al. | |
| 6,594,996 | B2 * | 7/2003 | Yang | 60/602 |
| 6,810,850 | B2 * | 11/2004 | Anderson et al. | 123/323 |
| 6,827,067 | B1 * | 12/2004 | Yang et al. | 123/568.14 |
| 6,866,017 | B2 * | 3/2005 | Ruggiero et al. | 123/321 |
| 6,883,492 | B2 * | 4/2005 | Vanderpoel et al. | 123/321 |
| 6,925,976 | B2 * | 8/2005 | Israel et al. | 123/90.12 |
| 2003/0019470 | A1 | 1/2003 | Anderson | |
| 2003/0221663 | A1 | 12/2003 | Vanderpoel et al. | |

* cited by examiner

*Primary Examiner* — Zelalem Eshete

(74) *Attorney, Agent, or Firm* — David R. Yohannan; Kelley Drye & Warren LLP

(57) ABSTRACT

An internal combustion engine that includes both a variable valve actuation system and an exhaust restriction system to provide engine braking are disclosed. Variable valve actuation and exhaust gas restriction are carried out in response to one or more engine parameters such as engine speed, engine load, vehicle speed, and/or manifold temperature and pressure. Variable valve actuation and exhaust gas restriction may be controlled to provide selective engine performance during positive power operation and/or during engine braking operation.

13 Claims, 3 Drawing Sheets

COMBINED EXHAUST RESTRICTION AND VARIABLE VALVE ACTUATION

CROSS-REFERENCE TO RELATED APPLICATIONS

This application is a continuation in part of, relates to, and claims the priority of U.S. provisional patent application Ser. No. 60/601,984 which was filed Aug. 17, 2004.

FIELD OF THE INVENTION

The present invention generally relates to internal combustion engines that use variable valve actuation (VVA) systems and exhaust restriction.

BACKGROUND OF THE INVENTION

In an internal combustion engine, engine valve actuation is required in order to produce positive power, and may also be used to produce engine braking and/or exhaust gas recirculation (EGR). During positive power, one or more intake valves may be opened to admit air into a cylinder for combustion during the intake stroke of the piston. One or more exhaust valves may be opened to allow combustion gases to escape from the cylinder during the exhaust stroke of the piston.

One or more exhaust valves may also be selectively opened to convert, at least temporarily, the engine into an air compressor for engine braking operation. This air compressor effect may be accomplished by either cracking open one or more exhaust valves near piston top dead center (TDC) position for compression-release type braking, or by maintaining one or more exhaust valves in a cracked open position during much or all of the piston motion, for bleeder type braking. In either of these methods, the engine may develop a retarding force that may be used to help slow a vehicle down. This braking force may provide the operator with increased control over the vehicle, and may also substantially reduce the wear on the service brakes. Engine braking has been long known and is disclosed in Cummins, U.S. Pat. No. 3,220,392 (November 1965), which is hereby incorporated by reference.

The braking power of a compression-release type engine brake may be increased by selectively actuating the exhaust valves to carry out brake gas recirculation in combination with compression release braking. Brake gas recirculation (BGR) denotes the process of opening an exhaust or auxiliary valve on the intake or expansion stroke of the piston and/or opening an intake or auxiliary valve during the exhaust or compression stroke of the engine. During engine braking, the introduction of exhaust gases from the exhaust manifold into the cylinder may increase the total gas mass in the cylinder at the time of the compression release event. This increased gas mass in the engine cylinder may increase the braking effect realized by the compression-release event.

An example of a lost motion system and method used to obtain retarding and brake gas recirculation is provided by Gobert, U.S. Pat. No. 5,146,890 (Sep. 15, 1992) which discloses a method of conducting brake gas recirculation by placing the cylinder in communication with the exhaust system during the first part of the compression stroke and optionally also during the latter part of the intake stroke, and which is hereby incorporated by reference. Gobert uses a lost motion system to enable and disable retarding and brake gas recirculation, but such system is not variable within an engine cycle, i.e., this system does not provide variable valve actuation (VVA).

Intake, exhaust, and/or auxiliary valves may also be actuated to provide exhaust gas recirculation (EGR) for improved engine performance during positive power operation. Actuating the exhaust valve during positive power to provide EGR may cause exhaust gas in the exhaust manifold to flow back into the cylinder and/or exhaust gas in the cylinder to flow back into the intake manifold. The recirculation of the exhaust gases may lower the combustion temperature and reduce NOx emissions. An example of the use of EGR to reduce NOx emissions during positive power operation of an engine is disclosed in Israel, U.S. Pat. No. 6,170,474 (Jan. 9, 2001), which is hereby incorporated by reference.

In many internal combustion engines, the intake and exhaust valves may be actuated by fixed profile cams, and more specifically, by one or more fixed lobes that are an integral part of each cam. For example, an intake cam profile may include an additional lobe for EGR/BGR prior to the main intake lobe, and/or an exhaust cam profile may include an additional lobe for EGR/BGR after the main exhaust lobe. Other auxiliary lobes may be included on the cam to provide cylinder charging events, compression-release events, or bleeder braking events. The fixed profile cams will produce fixed valve events in terms of timing and lift unless a specialized system is included in the valve train to provide variable valve actuation.

Benefits such as increased performance, improved fuel economy, lower emissions, increased braking power, and/or better vehicle drivability may be obtained if the intake and exhaust valve timing and/or lift can be varied using a variable valve actuation system. It may be particularly beneficial to adjust valve timing and/or lift to improve performance based on changes to various engine operating conditions, such as different engine speeds, loads, and engine component temperatures and pressures.

One method of adjusting valve timing and lift, given a fixed cam profile, has been to provide variable valve actuation (VVA) by incorporating a lost motion device in the valve train between the valve and the cam. Lost motion is the term applied to a class of technical solutions for modifying the valve motion proscribed by a cam profile with a variable length mechanical, hydraulic, or other linkage assembly. In a lost motion system, a cam lobe may provide the maximum motion (longest dwell and greatest lift) needed over a full range of engine operating conditions. A variable length system may then be included in the valve train intermediate of the valve to be opened and the cam providing the maximum valve actuation motion, to subtract or lose part or all of the motion imparted by the cam to the valve. The lost motion VVA system may be used to selectively cancel or activate any or all combinations of valve lifts possible from the assortment of lobes provided on the intake and exhaust cams.

Engine benefits from lost motion VVA systems can be achieved by creating complex cam profiles with extra lobes or bumps to provide auxiliary valve lifts in addition to the conventional main intake and exhaust events. Many unique modes of engine valve actuation may be produced by a VVA system that includes multi-lobed cams. As a result, significant improvements may be made to both positive power and engine braking operation of the engine. Examples of VVA systems are disclosed in Vorih et al., U.S. Pat. No. 6,510,824 (Jan. 28, 2003), entitled "Variable Lost Motion Valve Actuation and Method;" and Vanderpoel et al., U.S. patent application Pub. No. US 2003/0221663 A1 (Dec. 4, 2003) entitled "Compact Lost Motion System for Variable Valve Actuation," both of which are incorporated herein by reference.

It may also be desirable to increase the exhaust back pressure in the exhaust manifold during engine braking, and in particular compression-release braking. During compression-release engine braking, a large force may be needed to open the exhaust valve against the relatively high pressure that occurs in the engine cylinder near piston top dead center position. Increased exhaust back pressure may increase the pressure on the back side of the valve which may counter the pressure exerted by the gases in the cylinder and thus reduce the loading on the mechanism used to open the exhaust valve for compression-release events. Increased exhaust back pressure may also increase the pressure in the engine cylinder during the piston's compression stroke and thereby increase the braking power that the piston exerts on the crankshaft.

Increasing the pressure of gases in the exhaust manifold may be accomplished by restricting the flow of gases through the exhaust manifold. Exhaust manifold restriction may be accomplished through the use of any structure that restricts all or partially all of the flow of exhaust gases through the exhaust manifold. The exhaust restrictor may be in the form of an exhaust brake, a turbocharger, a variable geometry turbocharger, a variable geometry turbocharger with a variable nozzle turbine, and/or any other device which may limit the flow of exhaust gases through the engine and exhaust system.

Exhaust brakes generally provide restriction by closing off all or part of the exhaust manifold, thereby preventing the exhaust gases from escaping. This restriction of the exhaust gases may provide a braking effect on the engine by providing back pressure when each cylinder is on the exhaust stroke. For example, Meneely, U.S. Pat. No. 4,848,289 (Jul. 18, 1989); Schaefer, U.S. Pat. No. 6,109,027 (Aug. 29, 2000); Israel, U.S. Pat. No. 6,170,474 (Jan. 9, 2001); Kinerson et al., U.S. Pat. No. 6,179,096 (Jan. 30, 2001); and Anderson et al., U.S. patent application Pub. No. US 2003/0019470 (Jan. 30, 2003) disclose exhaust brakes for use in retarding engines.

Turbochargers may similarly restrict exhaust gas flow from the exhaust manifold. Turbochargers often use the flow of high pressure exhaust gases from the exhaust manifold to power a turbine. A variable geometry turbocharger (VGT) may alter the amount of the high pressure exhaust gases that it utilizes to drive a turbine. For example, Arnold et al., U.S. Pat. No. 6,269,642 (Aug. 7, 2001) discloses a variable geometry turbocharger capable of modifying the angle and the length of the vanes in a turbine to vary the amount of exhaust gas restriction. An example of the use of a variable geometry turbocharger in connection with engine braking is disclosed in Faletti et al., U.S. Pat. No. 5,813,231, which is hereby incorporated by reference.

SUMMARY OF THE INVENTION

Applicant has developed an innovative method for use in an internal combustion engine having an engine valve for controlling gas flow between a cylinder and an engine manifold, a variable valve actuation system for actuating said engine valve, and an exhaust gas restriction device for restricting the flow of exhaust gas out of an exhaust manifold, a method of providing engine valve actuation comprising the steps of: determining one or more engine operating parameters selected from the group consisting of engine speed, engine load, exhaust manifold pressure, and vehicle speed; selectively restricting exhaust gas flow through the exhaust manifold using the exhaust gas restriction device responsive to the one or more determined engine operating parameters; and selectively actuating the engine valve with the variable valve actuation system responsive to the one or more determined engine operating parameters.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention and, together with the detailed description, serve to explain the principles of the present invention.

BRIEF DESCRIPTION OF THE DRAWINGS

In order to assist in the understanding of this invention, reference will now be made to the appended drawings, in which like reference characters refer to like elements.

DETAILED DESCRIPTION OF THE EMBODIMENTS OF THE INVENTION

Figure 1:
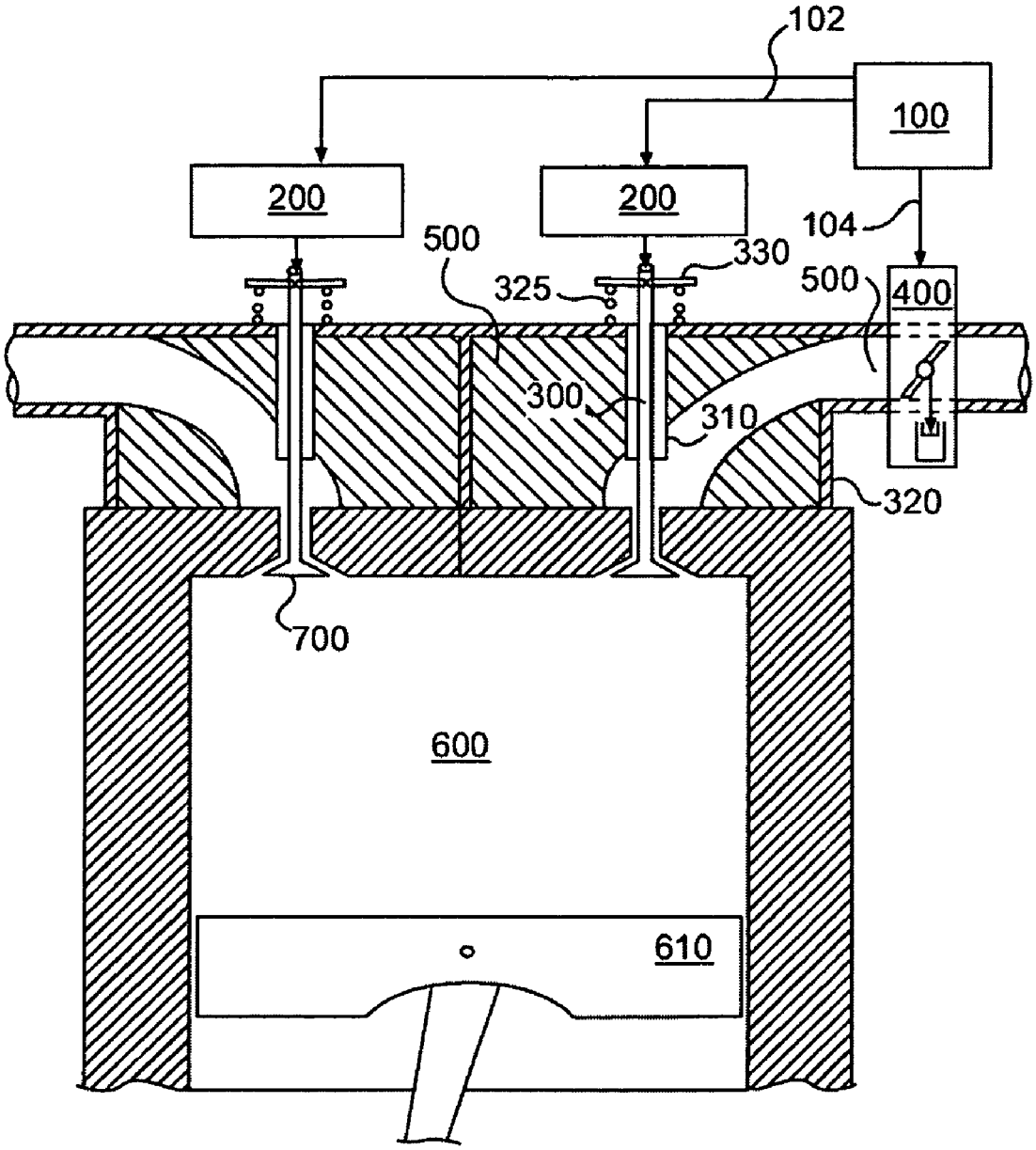
FIG. 1 is a schematic drawing in partial cross-section of a combined exhaust restriction and VVA system in accordance with an embodiment of the present invention and capable of providing method embodiments of the present invention.

Reference will now be made in detail to embodiments of the present invention, examples of which are illustrated in the accompanying drawings. FIG. 1 shows a first embodiment of the present invention, which includes an engine control module (ECM) 100, a variable valve actuation (VVA) system 200, a first engine valve 300, a second engine valve 700, an exhaust manifold 500, an exhaust gas restriction device 400, and an engine cylinder 600.

The engine control module 100 may be connected to one or more engine components in order to determine engine speed, engine load, and/or optionally other engine parameters such as engine temperatures and pressures (e.g., oil, coolant, manifold, and other temperatures and pressures). The ECM 100 may include a processor adapted to determine control signals for the VVA system 200 and the exhaust gas restriction device 400 based on the engine parameter signals received from the one or more engine components. The ECM determination may be made in real-time or at a later time for use when similar engine parameters repeat themselves. Signal transmission paths 102 and 104 may connect the ECM 100 to the VVA system 200 and the exhaust gas restriction device 400, respectively. The signal transmission paths 102 and 104 may be implemented as wired or wireless elements. Control signals generated by the ECM 100 may be transmitted to the VVA system 200 and the exhaust gas restriction device 400 over the signal transmission paths 102 and 104.

The VVA system 200 may be capable of selectively varying the actuation of the engine valve 300 in response to engine operating conditions, such as engine braking mode versus positive power operation mode. It is appreciated that the system may be implemented using any VVA system, not only those disclosed in the aforenoted patent and publication. The VVA system 200 may be connected to any one or combination of cam(s), push-tube(s), rocker arm(s) and/or other mechanical, electro-mechanical, hydraulic, or pneumatic devices for imparting actuation motion to the VVA system.

The VVA system 200 may vary the opening and/or closing times of the engine valve(s) 300 in response to control signals received from the ECM 100. This adjustment may be used to control various engine performance characteristics, such as NOx production and/or engine braking power.

In a preferred embodiment, the engine valve 300 is an exhaust valve, although it is appreciated that the engine valve could be implemented as an auxiliary valve. The engine valve 300 may be slidably disposed through a sleeve 310 mounted in the cylinder head 320. A valve rotator 330 may be connected to an upper end of the engine valve 300. A spring 325 may act through the valve rotator 330 to bias the engine valve 300 towards the VVA system 200 such that the engine valve prevents gas flow between the engine cylinder 600 and the exhaust manifold 500 when the engine valve is closed (as shown). The VVA system 200 may selectively depress the engine valve 300 into the cylinder 600 (i.e., actuate the valve) to provide for selective gas flow between the cylinder 600 and the exhaust manifold 500. The direction of gas flow between the cylinder 600 and the exhaust manifold 500 may depend upon the relative gas pressures in each.

The engine valve 300 may be actuated by the VVA system 200 to produce various engine valve events, such as but not limited to: main exhaust events, compression release braking events, bleeder braking events, exhaust gas recirculation events, brake gas recirculation events, early exhaust valve opening and/or closing events, centered lift, and the like.

The exhaust restrictor 400 may be connected to the exhaust manifold 500 or to the exhaust pipe downstream of the exhaust manifold. The exhaust restrictor 400 may be selectively actuated in response to a signal from the ECM 100 to partially or fully restrict the flow of gas through the exhaust manifold 500. The exhaust restrictor 400 may be adapted to vary the amount of gas flow restriction on a real-time basis in response to signal changes from the ECM 100. Mechanically, the exhaust gas restrictor 400 may be implemented as an exhaust brake or as a turbocharger, and more preferably as a variable geometry turbocharger, or a variable geometry turbocharger with a variable nozzle turbine.

With continued reference to FIG. 1, the operation of the first embodiment of the present invention will now be discussed. During positive power, the ECM 100 may be provided with engine parameter information, such as, for example, engine speed, engine load, vehicle speed, manifold pressure and manifold temperature. Based on one or more of these engine parameters, the ECM 100 may determine the desired actuation timing for the engine valve 300 (including whether or not to provide EGR) and the level of exhaust gas restriction for the exhaust gas restrictor 400. The ECM 100 may signal the VVA system 200 to actuate the engine valve 300 in accordance with the determine actuation timing. The ECM 100 may also signal the exhaust restrictor 400 to block the flow of some portion of the exhaust gases through the exhaust manifold 500 to provide the determined level of exhaust gas restriction. Thereafter, the engine valve 300 may be selectively actuated to permit communication between the cylinder 600 and the exhaust manifold 500. This communication may enable exhaust gas to flow between the cylinder 600 and the exhaust manifold 500 depending upon the relative pressures in each, which are at least partially controlled by the level of restriction provided by the exhaust gas restrictor 400. During the exhaust stroke of the piston 610, the VVA system 200 may open the engine valve 300 for a main exhaust event, and during the intake stroke, the VVA system may open the engine valve for an EGR event. Provided that the pressure in the cylinder 600 is less than that of the exhaust manifold 500, exhaust gas in the exhaust manifold may be re-circulated back into the cylinder 600 during the EGR event. The amount of exhaust gas recirculation may be selectively controlled by the ECM through combined control over the actuation timing for the exhaust valve 300 and the level of restriction provided by the exhaust restrictor 400. The EGR event may produce reduced emissions and decrease the amount of NOx produced by the combustion during positive power. The exhaust valve timing and exhaust restrictor setting may be varied depending on an emission reduction strategy selected for each engine operation mode.

During an engine braking event, the ECM 100 may continue to be provided with engine parameter information, such as engine speed, engine load, vehicle speed, manifold pressure and manifold temperature. Based on one or more of these vehicle parameters, the ECM 100 may determine the desired actuation timing for the engine valve 300 and the level of exhaust gas restriction for the exhaust gas restrictor 400 for a predetermined level of engine braking. The exhaust manifold may have a pressure limit that should not be exceeded. The exhaust restriction system may maintain the pressure throughout the system below this maximum amount, through variations in engine speed. For example, the VVA system may open the exhaust valve for compression release at approximately 60 to 70 degrees before TDC at high engine speeds (approximately 1800 rpm to 2300 rpm) and may open the exhaust valve approximately 40 to 60 degrees before TDC at engine speeds lower than approximately 1500 rpm.

Figure 2:
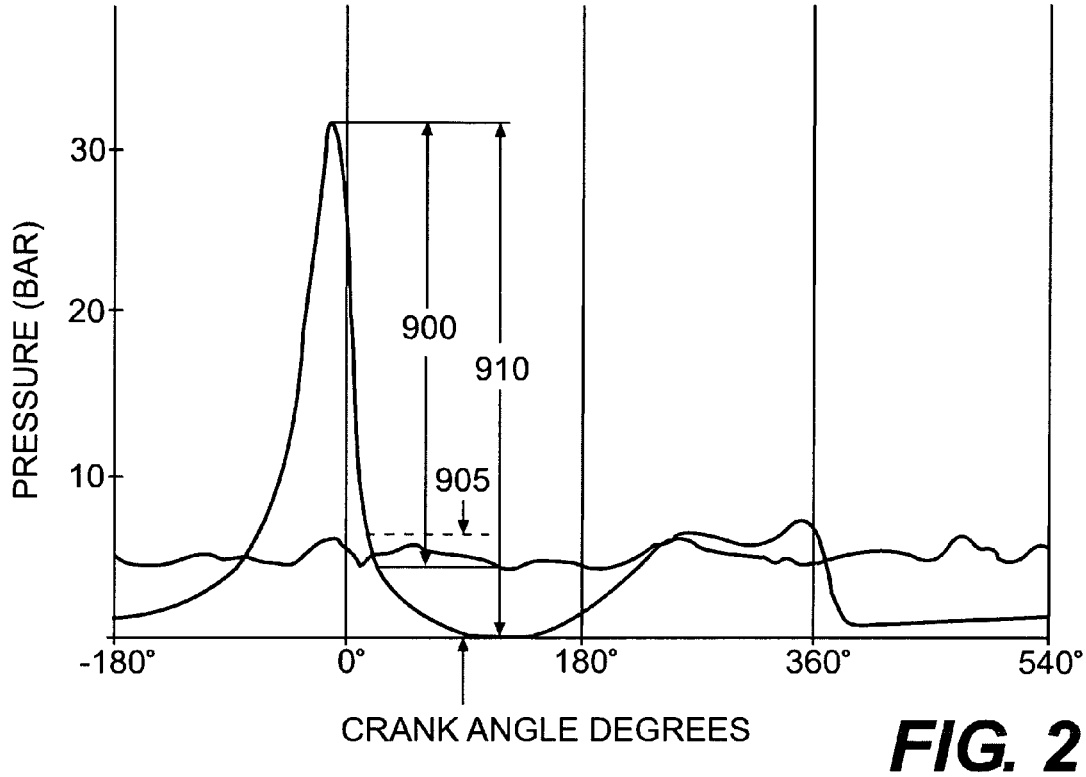
FIG. 2 is a graph of an example of calculated relative engine cylinder pressure and manifold pressure in accordance with an embodiment of the present invention.

With continued reference to FIG. 1, during an exhaust stroke of the piston 600, the exhaust restrictor 400 may restrict the flow of the exhaust gases, which may thereby trap the exhaust gases in the exhaust manifold 500. During an engine braking event, this increased pressure in the exhaust manifold 500 may cause pressure to be applied to the back side (i.e., valve stem side) of the engine valve 300. An example pressure differential between the two sides of the engine valve 300 is illustrated in FIG. 2. The amount of force necessary to open the engine valve 300 may be decreased by the amount of pressure maintained on the outside surface of the engine valve, or in other words, by the exhaust back pressure in the exhaust manifold 500. As a result, the amount of pressure that the VVA system 200 must apply to actuate the engine valve may be reduced. This reduction is apparent in FIG. 2 as the difference 905 between pressure magnitude 900 (cylinder pressure minus exhaust back pressure with the exhaust restrictor in effect) and pressure magnitude 910 (cylinder pressure minus exhaust back pressure without the exhaust restrictor in effect). The reduction in the required VVA force based on determined engine parameters may enable the engine valve 300 to be opened later in the compression cycle for a particular engine condition (e.g., speed) and may thereby increase the braking power for that engine condition.

Figure 3:
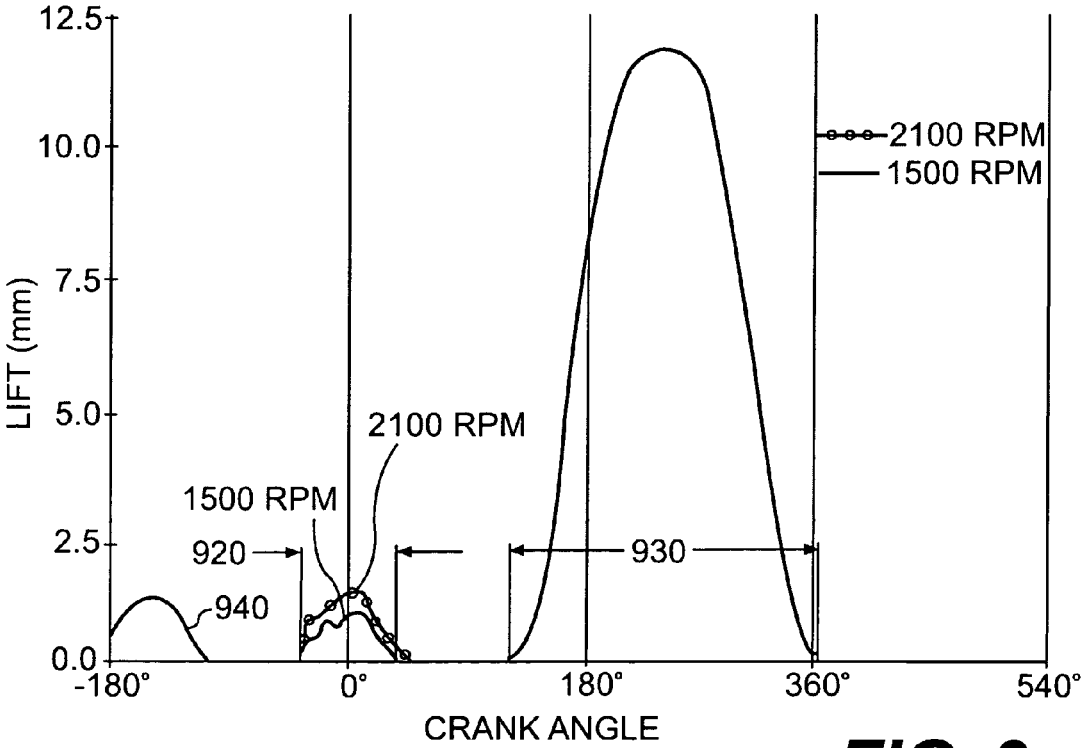
FIG. 3 is a graph of an example of calculated exhaust valve lift provided in accordance with an embodiment of the present invention.

FIG. 3 illustrates an example of engine valve actuation for four-cycle engine braking with BGR. A BGR event 940 may occur during the latter portion of the intake stroke and/or the early portion of the compression stroke. During the BGR event 940, the engine valve may be opened to permit exhaust gas to flow into the cylinder from the exhaust manifold. Near the end of the compression stroke, compression-release event 920 may be carried out. The magnitude of the BGR event 940 and/or the compression-release event 920 may be varied in accordance with engine speed or other parameter, as indicated in FIG. 3. The main exhaust event 930 may be carried out during the exhaust stroke.

With continued reference to FIG. 3, the BGR event 940 may be used as an EGR event 940 during positive power. If the EGR event 940 is desired during positive power operation of the engine, the compression-release event 920 may be eliminated by the VVA system. Inclusion of the EGR event 940 during positive power in selective combination with exhaust gas restriction may be used to control NOx production by the engine. Control over the VVA system and thus NOx production may based on the engine parameters sensed by the ECM.

The VVA system 200 may also permit selective switching between four-cycle and/or two-cycle engine braking based on the engine parameters determined by the ECM. Four-cycle engine braking may occur when the compression-release event 920 is carried out once per engine cycle near the end of the compression stroke of the piston 610, as shown in FIG. 3. Two-cycle engine braking occurs when the main exhaust event is eliminated or reduced, and compression-release events are carried out twice per engine cycle—near the end of both the exhaust and compression strokes of the piston 610. Selection of two-cycle or four-cycle braking may be based on engine parameters such as engine speed in particular to provide varied braking power.

Figure 4:
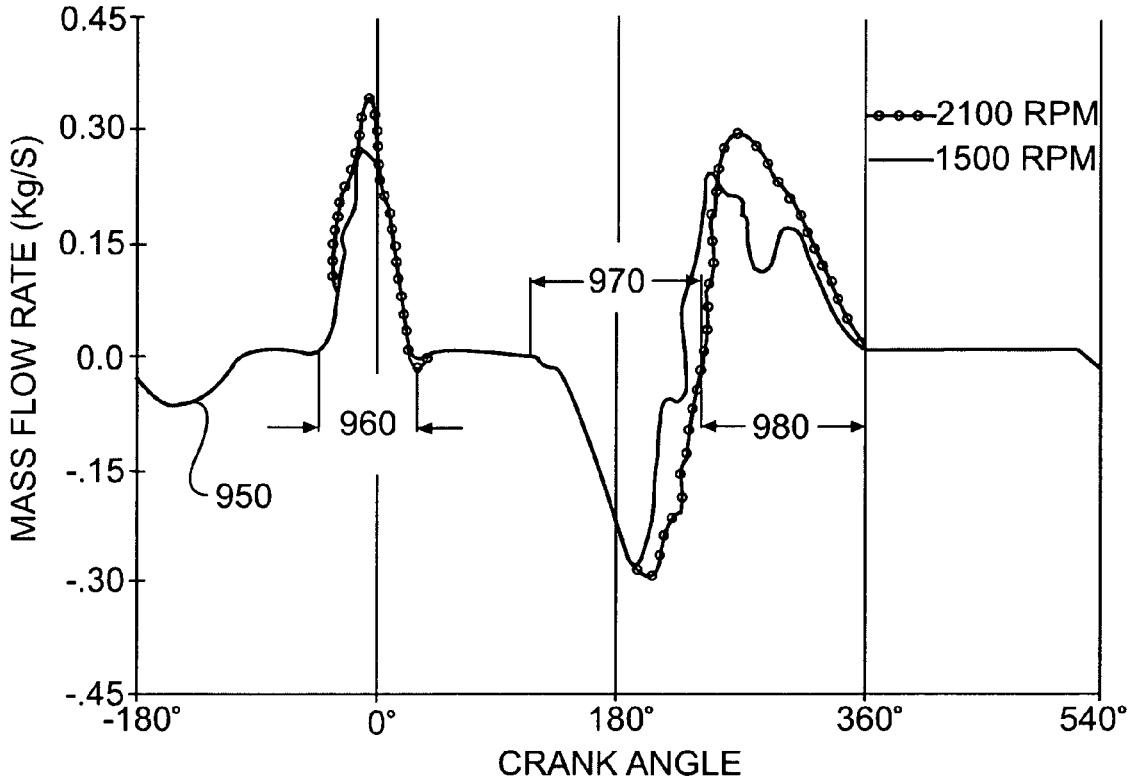
FIG. 4 is a graph of an example of calculated mass air-flow rate through an engine valve port in accordance with an embodiment of the present invention.

Calculated mass flow rate through an engine valve communicating with the exhaust manifold is shown in FIG. 4 for an engine braking mode of operation. The engine valve may be opened during a BGR event 950 to permit exhaust gas in the exhaust manifold to flow into the cylinder and further charge the cylinder for a compression-release event. Near the end of the compression stroke, the engine valve may be opened again for the compression-release event 960. The engine goes through the expansion stroke between crank angles 0-180, following the compression stroke. During the expansion stroke, the pressure in the cylinder may drop below the pressure in the exhaust manifold, which may cause an engine valve float event 970 to occur. During the engine valve float event 970, exhaust gas pressure in the exhaust manifold may force the engine valve open and permit exhaust gas to flow from the exhaust manifold into the cylinder. Subsequently, the engine valve may be actuated by the VVA system for the main exhaust event 980, during which the piston forces exhaust gas in the cylinder back into the exhaust manifold. Calculated gas mass flow for 1500 and 2100 RPM engine speeds are illustrated. Selective control over the exhaust restrictor, the timing of the BGR event 950 and the compression-release event 960 may be used to provide a predetermined level of engine braking.

It will be apparent to those skilled in the art that variations and modifications of the present invention can be made without departing from the scope or spirit of the invention. For example, the lost motion VVA system and exhaust gas restrictor illustrated in FIG. 1 are intended to be illustrative and not limiting. Thus, it is intended that the present invention cover all such modifications and variations of the invention, provided they come within the scope of the appended claims and their equivalents.

What is claimed is:

1. In an internal combustion engine having an engine valve for controlling gas flow between a cylinder and an engine manifold, a variable valve actuation system for actuating said engine valve, and a variable exhaust gas restriction device for restricting the flow of exhaust gas out of an exhaust manifold, a method of providing a selective level of brake gas recirculation to achieve a desired level of engine braking power or a selective level of exhaust gas recirculation to achieve a desired level of NOx production, through the combined control of engine variable valve actuation and variable exhaust gas restriction, said method comprising the steps of:

determining one or more engine operating parameters selected from the group consisting of engine speed, engine load, exhaust manifold pressure, and vehicle speed;

determining both a desired actuation timing for the engine valve using the variable valve actuation system and a desired level of exhaust gas restriction for the exhaust gas restriction device based on the one or more determined engine operating parameters to provide a selective level of brake gas recirculation or a selective level of exhaust gas recirculation; and providing the desired level of exhaust gas restriction and the desired actuation timing for the engine valve required to provide the selective level of brake gas recirculation or the selective level of exhaust gas recirculation.

2. The method of claim 1, wherein the exhaust gas restriction device is an exhaust brake.

3. The method of claim 1, wherein the exhaust gas restriction device is a turbocharger.

4. The method of claim 3, wherein the turbocharger is a variable geometry turbocharger.

5. The method of claim 1, wherein the variable valve actuation system comprises:

a lost motion system; and a high speed trigger valve.

6. The method of claim 1, wherein the engine braking is compression-release braking.

7. The method of claim 1, wherein the engine braking is bleeder-type braking.

8. A method of providing a selective level of brake gas recirculation to achieve a desired level of engine braking power or a selective level of exhaust gas recirculation to achieve a desired level of NOx production using the combination of variable valve actuation for an internal combustion engine valve and variable exhaust gas restriction for an associated internal combustion engine exhaust system, said method comprising the steps of:

determining at least engine speed;

determining a desired exhaust gas restriction setting and a desired engine valve actuation timing based on the determined engine speed to provide the selective level of brake gas recirculation corresponding to the desired level of engine braking power or to provide the selective level of exhaust gas recirculation corresponding to the desired level of NOx production; and restricting exhaust gas flow through the exhaust system based on the determined desired exhaust gas restriction setting and actuating the engine valve based on the determined desired engine valve actuation timing to provide the desired level of engine braking power or the desired level of NOx production.

9. The method of claim 8, wherein the step of restricting exhaust gas flow includes the step of actuating an exhaust brake.

10. The method of claim 8, wherein the step of restricting exhaust gas flow includes the step of varying the restriction provided by a variable geometry turbocharger.

11. The method of claim 8, wherein the engine braking is compression-release braking.

12. The method of claim 8, wherein the engine braking is bleeder braking.

13. A method of providing a selective level of brake gas recirculation to achieve a desired level of engine braking power by providing a predetermined level of variable valve actuation for an internal combustion engine valve and a predetermined level of variable exhaust gas restriction for an associated internal combustion engine exhaust system, comprising the steps of:

determining one or more engine operating parameters;

determining a combination of a desired exhaust gas restriction setting and a desired engine valve actuation timing based on the one or more determined engine operating parameters to provide the selective level of brake gas recirculation corresponding to a desired level of engine braking power; and restricting exhaust gas flow through the exhaust system based on the predetermined desired exhaust gas restriction setting and actuating the engine valve based on the predetermined desired engine valve actuation timing to provide the desired level of engine braking power.

* * * * *